US011534637B2

(12) United States Patent
Yuan et al.

(10) Patent No.: US 11,534,637 B2
(45) Date of Patent: Dec. 27, 2022

(54) FIRE-FIGHTING WATER CANNON

(71) Applicant: Yanshan University, Qinhuangdao (CN)

(72) Inventors: Xiaoming Yuan, Qinhuangdao (CN); Yue Tang, Qinhuangdao (CN); Haodong Pang, Qinhuangdao (CN); Xuemei Zong, Qinhuangdao (CN); Bing He, Qinhuangdao (CN); Lijie Zhang, Qinhuangdao (CN)

(73) Assignee: Yanshan University, Qinhuangdao (CN)

( * ) Notice: Subject to any disclaimer, the term of this patent is extended or adjusted under 35 U.S.C. 154(b) by 174 days.

(21) Appl. No.: 17/210,600

(22) Filed: Mar. 24, 2021

(65) Prior Publication Data

US 2021/0299493 A1 Sep. 30, 2021

(30) Foreign Application Priority Data

Mar. 24, 2020 (CN) ..... 202010212035.7

(51) Int. Cl.
*A62C 31/03* (2006.01)
*B05B 1/12* (2006.01)

(52) U.S. Cl.
CPC ..... *A62C 31/03* (2013.01); *B05B 1/12* (2013.01)

(58) Field of Classification Search
CPC ..... A62C 31/03; B05B 1/12; B05B 1/3402; B05B 1/3033; B05B 1/3053
USPC ..... 239/456–458, 507, 538, 539
See application file for complete search history.

(56) References Cited

U.S. PATENT DOCUMENTS 3,192,710 A * 7/1965 Wilson, Jr. ..... F02K 9/86 239/455
5,323,963 A * 6/1994 Ballu ..... B05B 12/12 239/464
6,039,269 A * 3/2000 Mandzukic ..... B05B 1/12 239/DIG. 7

(Continued)

*Primary Examiner* — Jason J Boeckmann
(74) *Attorney, Agent, or Firm* — IPRO, PLLC

(57) ABSTRACT

The present invention discloses a Fire-fighting water cannon comprising: a first motor assembly including a first housing, a first stator assembly, a first rotor assembly and a central shaft; both ends of the first housing are respectively provided with a first end cover and a second end cover, the first end of the first stator assembly is connected with the second end cover, the first rotor assembly is sleeved on the outside of the first stator assembly, and the first rotor assembly is rotatably connected with the first housing; the cannon head assembly including a first cannon head and a second cannon head, the first cannon head is connected with the first stator assembly, the second cannon head is sleeved on the outside of the first cannon head, and the second cannon head is threadedly connected with the first rotor assembly, the first cannon head is provided with a first anti-rotation device; the cannon core assembly is arranged on the central axis and cooperates with the cannon head assembly. With this arrangement, the switching of the spray state of the Fire-fighting water cannon is controlled by electrical signals, which makes the switching easier and faster, the spray state of the Fire-fighting water cannon can be accurately controlled to meet the needs of various working environments and achieve the effect of saving energy and resources.

9 Claims, 3 Drawing Sheets

(56) References Cited

U.S. PATENT DOCUMENTS

2005/0242206 A1* 11/2005 Saner ..... B05B 3/04
239/296
2015/0209605 A1* 7/2015 Keim ..... B05B 1/12
239/524

* cited by examiner

FIRE-FIGHTING WATER CANNON

TECHNICAL FIELD

The present invention relates to the technical field of fire-fighting equipment, in particular to a Fire-fighting water cannon.

BACKGROUND TECHNOLOGY

The Fire-fighting water cannon is a fire-fighting equipment that extinguishes fires at a certain distance by spraying pressurized water at a high speed from the cannon head outlet through energy conversion to form a water jet. Fire-fighting water cannons mainly have two spray states: columnar form and misty form. The columnar form may be used for remote fixed-point fire fighting. The misty form can isolate the disaster and prevent the further expansion of the disaster. The appropriate method is determined by the disaster scene. However, the existing Fire-fighting water cannon has poor operability in switching the jet mode at the cannon head, and the switching is inconvenient. Therefore, the inconvenience of switching the jet mode of the Fire-fighting water cannon in the prior art is a problem that needs to be solved urgently by those skilled in the art.

SUMMARY OF THE INVENTION

In order to solve the above technical problems, the present invention provides a Fire-fighting water cannon that facilitates switching the jet mode.

In order to achieve the above objectives, the present invention provides the following solutions:

The present invention provides a Fire-fighting water cannon, comprising: a first motor assembly, including a first housing, a first stator assembly, a first rotor assembly, and a central shaft, wherein the first housing has a cavity inside and both ends of the first housing are respectively provided with a first end cover and a second end cover, the first stator assembly is arranged in the cavity and a first end of the first stator assembly is connected with the second end cover, the first rotor assembly is coaxially sleeved outside the first stator assembly with a gap therebetween, and the first rotor assembly is rotatably connected with the first housing through a bearing; when energized, the first rotor assembly rotates relative to the first stator assembly, and a first end of the center shaft is connected to a second end of the first stator assembly; a cannon head assembly comprising a first cannon head and a second cannon head each having a cylindrical structure, wherein a first end of the first cannon head passes through the first end cover and is connected to the second end of the first stator assembly, the second cannon head is coaxially sleeved on the outside of the first cannon head, and a first end of the second cannon head is threadedly connected with the first rotor assembly, and the first cannon head is provided with a first anti-rotation device that prevents the second cannon head from rotating, so that when the first rotor assembly rotates, the second cannon head is axially displaced along the first cannon head, and each of a second end of the first cannon head and a second end of the second cannon head is provided with a tapered wide mouth, and the second end cover and the first stator assembly are both provided with holes through which water flows, so that the water spray out from the cannon head assembly through the second end cover and the first stator assembly; a cannon core assembly, which is arranged on the central shaft and cooperates with the cannon head assembly to allow water to be discharged from a gap between the cannon head assembly and the cannon core assembly.

Further, the cannon core assembly includes a cannon core, a second motor assembly, a spring, and a transmission sleeve, wherein the second motor assembly includes a second stator assembly and a second rotor assembly, and the second stator assembly is fixedly arranged at a second end of the center shaft, the second rotor assembly is coaxially sleeved on the outside of the second stator assembly, and is rotatably connected to the central shaft through a bearing; when energized, the second rotor assembly rotates relative to the second stator assembly, the transmission sleeve is sleeved on the outside of the second rotor assembly and is threadedly connected with the second rotor assembly, the cannon core is integrally sleeved on the central shaft, and a first end of the cannon core is sleeved on the outside of the transmission sleeve, and the cannon core is provided with a second anti-rotation device for preventing the rotation of the transmission sleeve, so that when the second rotor assembly rotates, the transmission sleeve drives the cannon core to move along the central shaft, the spring is arranged inside the cannon core, and one end of the spring is against the second motor assembly, and the other end is against the cannon core, an arc-shaped matching portion for matching with the tapered wide mouth of the first cannon head is provided on an outer peripheral wall of the cannon core.

Further, the second stator assembly comprises a stator fixing ring sleeved on the central shaft and a second coil arranged on the stator fixing ring, the second rotor assembly includes a second housing and a second permanent magnet arranged in the second housing and opposite to the second coil; both ends of the second housing are respectively provided with a left end cover and a right end cover, the left end cover and the right end cover are respectively mounted on the central shaft through bearings.

Further, the first end of the cannon core is provided with a central hole, and the first end of the cannon core is sleeved outside the transmission sleeve through the central hole, the central hole is provided with a blocking cover, the blocking cover is sleeved on the central shaft, one end of the blocking cover is against the second motor assembly, the other end is against the spring, a sealing ring is arranged between the blocking cover and the central hole.

Further, the second anti-rotation device comprises a second positioning screw arranged on the cannon core, and the second positioning screw is threadedly connected with the cannon core, and a peripheral side wall of the transmission sleeve is provided with a positioning hole for the second positioning screw to extend into, and the second positioning screw extends through a side wall of the cannon core into the positioning hole.

Further, the first stator assembly comprises a flow stabilizer threadedly connected with the second end cover and a first coil mounted outside the flow stabilizer, the flow stabilizer is provided with a water flow channel through which the water flows. the first rotor includes a rotor fixing ring rotatably connected with the first housing through a bearing, and a first permanent magnet arranged on the rotor fixing ring and opposite to the first coil.

Further, external threads are provided on an outer circumferential side wall of a second end of the second cannon head, and the first end cover is provided with a iii clearance hole for the rotor fixing ring to extend, one end of the rotor fixing ring close to the first end cover is provided with an internal thread that matches with the external thread, and the second cannon head is screwed into the rotor fixing ring.

Further, a sealing ring is provided between the rotor fixing ring and the clearance hole.

Further, the first cannon head is connected to the flow stabilizer through a connecting sleeve, one end of the connecting sleeve is threadedly connected with the first cannon head, and the other end of the connecting sleeve is threadedly connected with the flow stabilizer, a sealing ring is arranged between the connecting sleeve and the rotor fixing ring, and a sealing ring is arranged between the first cannon head and the second cannon head.

Further, the first anti-rotation device comprises a first positioning screw threadedly connected to an outer circumferential side wall of the first cannon head, and the second cannon head is provided with a slide slot for the first positioning screw to extend into and slide therein, and the slide slot extends along the axial direction of the second cannon head.

The present invention achieves the following technical effects relative to the prior art:

The Fire-fighting water cannon of the present invention comprises: a first motor assembly, including a first housing, a first stator assembly, a first rotor assembly, and a central shaft, wherein the first housing has a cavity inside and both ends of the first housing are respectively provided with a first end cover and a second end cover, the first stator assembly is arranged in the cavity and a first end of the first stator assembly is connected with the second end cover, the first rotor assembly is coaxially sleeved outside the first stator assembly with a gap therebetween, and the first rotor assembly is rotatably connected with the first housing through a bearing; when energized, the first rotor assembly rotates relative to the first stator assembly, and a first end of the center shaft is connected to a second end of the first stator assembly; a cannon head assembly comprising a first cannon head and a second cannon head each having a cylindrical structure, wherein a first end of the first cannon head passes through the first end cover and is connected to the second end of the first stator assembly, the second cannon head is coaxially sleeved on the outside of the first cannon head, and a first end of the second cannon head is threadedly connected with the first rotor assembly, and the first cannon head is provided with a first anti-rotation device that prevents the second cannon head from rotating, so that when the first rotor assembly rotates, the second cannon head is axially displaced along the first cannon head, and each of a second end of the first cannon head and a second end of the second cannon head is provided with a tapered wide mouth, and the second end cover and the first stator assembly are both provided with holes through which water flows, so that the water spray out from the cannon head assembly through the second end cover and the first stator assembly; a cannon core assembly, which is arranged on the central shaft and cooperates with the cannon head assembly to allow water to be discharged from a gap between the cannon head assembly and the cannon core assembly.

When it is necessary to change the spray state of the Fire-fighting water cannon, the first motor assembly obtains an electrical signal, and the first rotor assembly rotates relative to the first stator assembly. Because the first rotor assembly and the second cannon head are connected by a thread pair, and the first anti-rotation device on the first cannon head prevents the second cannon head from rotating, when the first rotor assembly rotates, the second cannon head is displaced along the axial direction of the first cannon head, so that the distance between the tapered wide mouth at the second end of the second cannon head and the tapered wide mouth at the second end of the first cannon head is changed to change the spray state. With this arrangement, the switching of the spray state of the Fire-fighting water cannon is controlled by electrical signals, which makes the switching easier and faster, and the distance between the first cannon head and the second cannon head can be accurately controlled according to the number of rotations of the first rotor assembly. Thereby, the spray state of the Fire-fighting water cannon can be accurately controlled to meet the needs of various working environments and achieve the effect of saving energy and resources.

DESCRIPTION OF THE DRAWINGS

In order to describe the technical solutions in the embodiments of the present invention or in the prior art more clearly, the accompanying drawings required in the embodiments will be briefly introduced below. Obviously, the accompanying drawings in the following description are merely some embodiments of the present invention. For a person of ordinary skill in the art, other drawings can be obtained according to these accompanying drawings without creative efforts.

Description of Reference Signs: 1, first screw; 2, second end cover; 3, first bearing; 4, second screw; 5, first support ring; 6, rotor fixing ring; 7, first permanent magnet; 8, first coil; 9, flow stabilizer; 10, third screw; 11, second support ring; 12, second bearing; 13, first housing; 14, first sealing ring; 15, second seal ring; 16, second cannon head; 17, connecting sleeve; 18, first positioning screw; 19, first cannon head; 20, third sealing ring; 21, cannon core; 22, fourth sealing ring; 23, fifth sealing ring; 24, blocking cover; 25, fourth screw; 26, right end cover; 27, second positioning screw; 28, transmission sleeve; 29, second housing; 30, fifth screw; 31, second permanent magnet; 32, second coil; 33, stator fixing ring; 34, third bearing; 35, left end cover; 36, central shaft; 37, first sleeve; 38, second sleeve; 39, fourth bearing; 40, spring; 41, connecting ring.

DETAILED DESCRIPTION OF THE PREFERRED EMBODIMENTS

The technical solutions in the embodiments of the present invention will be clearly and completely described below with reference to the accompanying drawings in the embodiments of the present invention, and it is clear that the described embodiments are merely a part of embodiments of the present invention, rather than all of them. Based on the embodiments of the present invention, all other embodiments obtained by those skilled in the art without creative efforts fall within the scope of protection of the present invention.

It is an object of the present invention to provide a Fire-fighting water cannon that facilitates switching the jet mode.

In order to make the above-mentioned objects, features and advantages of the present invention more apparent, the present invention will be further described in detail below with reference to the accompanying drawings and specific embodiments.

Figure 1:
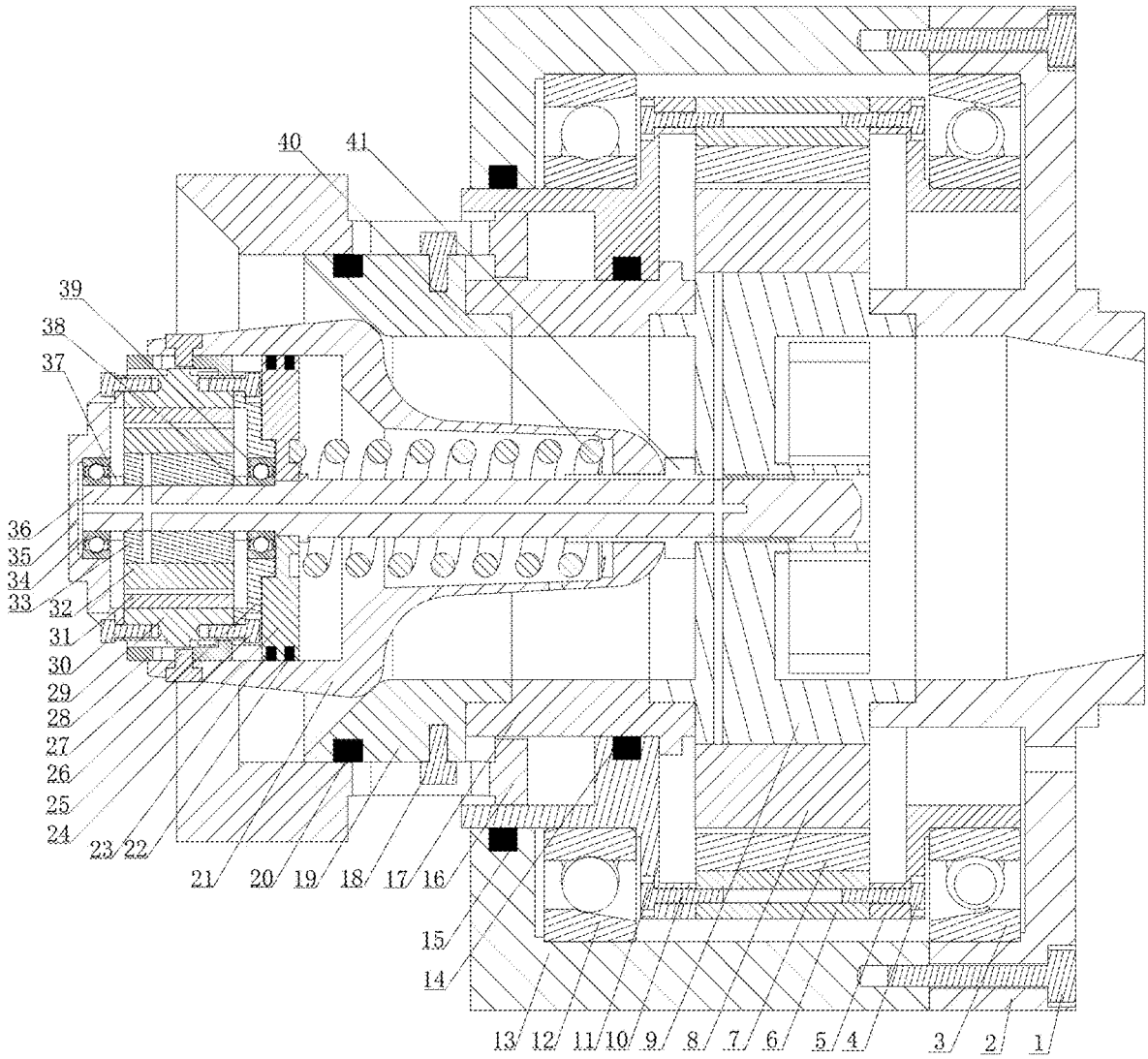
FIG. 1 is a schematic structural view of a Fire-fighting water cannon in an embodiment of the present invention.
Figure 2:
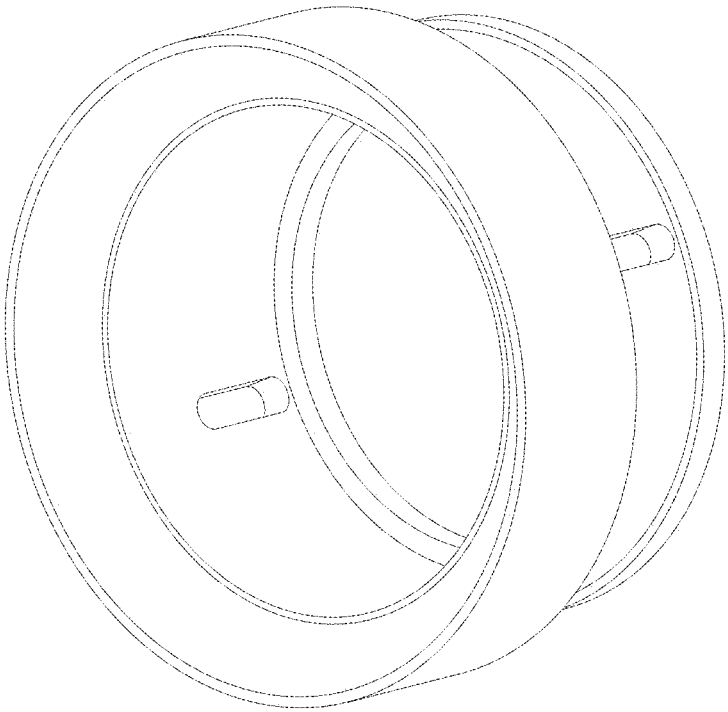
FIG. 2 is a schematic structural view of the second cannon head of the Fire-fighting water cannon in FIG. 1.

Referring to FIGS. 1-4, a Fire-fighting water cannon provided by an embodiment of the present invention includes a first motor assembly, a cannon head assembly, and a cannon core assembly. Wherein, the first motor assembly includes a first housing 13, a first stator assembly, a first rotor assembly and a central shaft 36. The first housing 13 has a cavity inside, and both ends of the first housing 13 are respectively provided with a first end cover and a second end cover 2. As shown in FIG. 1, the first end cover is located on the left side of the first housing 13 and may be an integral structure with the first housing 13, and the second end cover 2 is provided on the right side of the first housing 13 and is connected to the first housing 13 by the first screw 1. The first stator assembly is arranged in the cavity of the first housing 13, and the first end of the first stator assembly is connected with the second end cover 2. The first rotor assembly is coaxially sleeved outside the first stator assembly with a gap therebetween. The first rotor assembly is rotatably connected with the first housing 13 through a bearing. When energized, the first rotor assembly and the first stator assembly rotate relatively. The first end of the central shaft 36 is connected to the second end of the first stator assembly.

Wherein, the cannon head assembly includes a first cannon head 19 and a second cannon head 16, and the first cannon head 19 and the second cannon head 16 are both cylindrical structures. The first cannon head 19 passes through the first end cover and is connected to the second end of the first stator assembly. The second cannon head 16 is coaxially sleeved on the outside of the first cannon head 19, and the first end of the second cannon head 16 is threadedly connected with the first rotor assembly. The first cannon head 19 is also provided with a first anti-rotation device for preventing the second cannon head 16 from rotating, so that when the first rotor assembly rotates, the second cannon head 16 is axially displaced along the first cannon head 19. Each of the second end of the first cannon head 19 and the second end of the second cannon head 16 is provided with a tapered wide mouth. As shown in FIG. 1, when the tapered wide mouth of the first cannon head 19 and the tapered wide mouth of the second cannon head 16 are far apart, the spray state of the Fire-fighting water cannon is in a columnar form. When the tapered wide mouth of the first cannon head 19 and the tapered wide mouth of the second cannon head 16 are relatively close, the spray state of the Fire-fighting water cannon is in a misty form. Both the second end cover 2 and the first stator assembly are provided with holes through which water flows, so that water can be sprayed from the cannon head assembly through the second end cover 2 and the first stator assembly. Referring to FIG. 1, the right side of the second end cover 2 may be connected to an external water source.

Wherein, the cannon core assembly is arranged on the central shaft 36 and cooperates with the cannon head assembly to allow water to be discharged from the gap between the cannon head assembly and the cannon core assembly.

When it is necessary to change the spray state of the Fire-fighting water cannon, the first motor assembly obtains an electrical signal, and the first rotor assembly rotates relative to the first stator assembly. Because the first rotor assembly and the second cannon head 16 are connected by a thread pair, and the first anti-rotation device on the first cannon head 19 prevents the second cannon head 16 from rotating, when the first rotor assembly rotates, the second cannon head 16 is displaced along the axial direction of the first cannon head 19, so that the distance between the tapered wide mouth at the second end of the second cannon head 16 and the tapered wide mouth at the second end of the first cannon head 19 is changed to change the spray state. With this arrangement, the switching of the spray state of the Fire-fighting water cannon is controlled by electrical signals, which makes the switching easier and faster, and the distance between the first cannon head 19 and the second cannon head 16 can be accurately controlled according to the number of rotations of the first rotor assembly. Thereby, the spray state of the Fire-fighting water cannon can be accurately controlled to meet the needs of various working environments and achieve the effect of saving energy and resources.

In some embodiments, the cannon core assembly includes a cannon core 21, a second motor assembly, a spring 40 and a transmission sleeve 28. The second motor assembly includes a second stator assembly and a second rotor assembly. The second stator assembly is fixedly arranged at the second end of the central shaft 36, and the second rotor assembly is coaxially sleeved outside the second stator assembly with a gap between the two. The second rotor assembly is rotatably connected with the central shaft 36 through a bearing. When energized, the second rotor assembly rotates relative to the second stator assembly. The transmission sleeve 28 is sleeved on the outside of the second rotor assembly and is threadedly connected with the second rotor assembly. The cannon core 21 is integrally sleeved on the central shaft 36, and the first end of the cannon core 21 is sleeved on the outside of the transmission sleeve 28. The cannon core 21 is provided with a second anti-rotation device for preventing the rotation of the transmission sleeve 28, when the second rotor assembly rotates, the transmission sleeve 28 is axially displaced and drives the second anti-rotation device to move, so that the second anti-rotation device drives the cannon core 21 to move along the central shaft 36. The spring 40 is arranged inside the cannon core 21, one end of which abuts against the second motor assembly, and the other end against the inner wall of the cannon core 21. The outer peripheral wall of the cannon core 21 is provided with an arc-shaped matching part for matching with the tapered wide mouth of the first cannon head 19. The arc-shaped matching part is matched with the tapered wide mouth of the first cannon head 19, so that the water entering from the second end cap 2 flows out between the arc-shaped matching part and the tapered wide mouth of the first cannon head 19.

With this arrangement, the cannon core 21 is pressed against the tapered wide mouth of the first cannon head 19 under the pressure of the spring 40, and the spring 40 is compressed with the water pressure so that the mouth of the cannon core 21 can be adaptively controlled. In addition, the user can also actively control the spray flow of the Fire-fighting water cannon according to actual needs. For example, when the spray flow needs to be expanded, the second motor assembly obtains an electrical signal, and the second rotor assembly rotates. Because the second rotor assembly and the transmission sleeve 28 are connected by a thread pair, and the cannon core 21 is provided with a second anti-rotation device to prevent the rotation of the transmission sleeve 28, so when the second rotor assembly rotates, the transmission sleeve 28 is displaced axially along of the cannon core 21 to the left in FIG. 1 and drives the second anti-rotation device to move. The second anti-rotation device drives the cannon core 21 to move to the left, so that the gap between the cannon core 21 and the first cannon head 19 is enlarged to increase the spray flow rate. When the flow rate needs to be reduced, the operation is reversed. In this way, the adjustment of the spray flow is simple and convenient, and the spray flow of the Fire-fighting water cannon can be accurately adjusted.

Referring to FIG. 1, in some embodiments, the second stator assembly includes a stator fixing ring 33 sleeved on the central shaft 36 and a second coil 32 arranged on the stator fixing ring 33. The winding method of the coil belongs to the prior art and does not belong to the emphasis discussed herein, and will not be described herein again. The second rotor assembly includes a second housing 29 and a second permanent magnet 31 arranged inside the second housing 29 and opposite to the second coil 32. After the current flows into the second coil 32, an electromagnetic field is generated to force the second permanent magnet 31, causing the second rotor assembly to rotate. Both ends of the second housing 29 are respectively provided with a left end cover 35 and a right end cover 26. For example, the left end cover 35 may be rotatably mounted on the central shaft 36 through a third bearing 34, and the right end cover 26 may be rotatably mounted on the central shaft 36 through a fourth bearing 39. The outer circumferential wall of the second housing 29 is provided with an external thread, and the inner circumferential wall of the transmission sleeve 28 is provided with an internal thread matching the external thread. Referring to FIG. 1, the left end cover 35 may be detachably connected to the second housing 29 by a fifth screw 30, and the right end cover 26 may be detachably connected to the second housing 29 by a fourth screw 25.

In some embodiments, the first end of the cannon core 21 is provided with a central hole, and the first end of the cannon core 21 is sleeved outside the transmission sleeve 28 through the central hole. A blocking cover 24 is arranged in the central hole. The blocking cover 24 is sleeved on the central shaft 36. One end of the blocking cover 24 abuts against the second motor assembly and the other end against the spring 40. A sealing ring is arranged between the blocking cover 24 and the central hole. Referring to FIG. 1, specifically, the second motor assembly further includes a first sleeve 37 and a second sleeve 38, and a positioning shoulder is provided on the central shaft 36. The first sleeve 37 and the second sleeve 38 are both sleeved on the central shaft 36, wherein the second sleeve 38 is arranged between the right end cover 26 and the stator fixing ring 33, and the first sleeve 37 is arranged between the left end cover 35 and the stator fixing ring 33, and the first sleeve 37 is threadedly connected with the central shaft 36 to compress the stator fixing ring 33, the second sleeve 38, the inner ring of the bearing of the right end cover 26, and the blocking cover 24 to the positioning shoulder of the central shaft 36. The sealing ring between the blocking cover 24 and the center hole can prevent the water entering from the second end of the cannon core 21 from entering the second motor assembly. Optionally, the sealing ring between the blocking cover 24 and the central hole may include a fourth sealing ring 22 and a fifth sealing ring 23.

Figure 3:
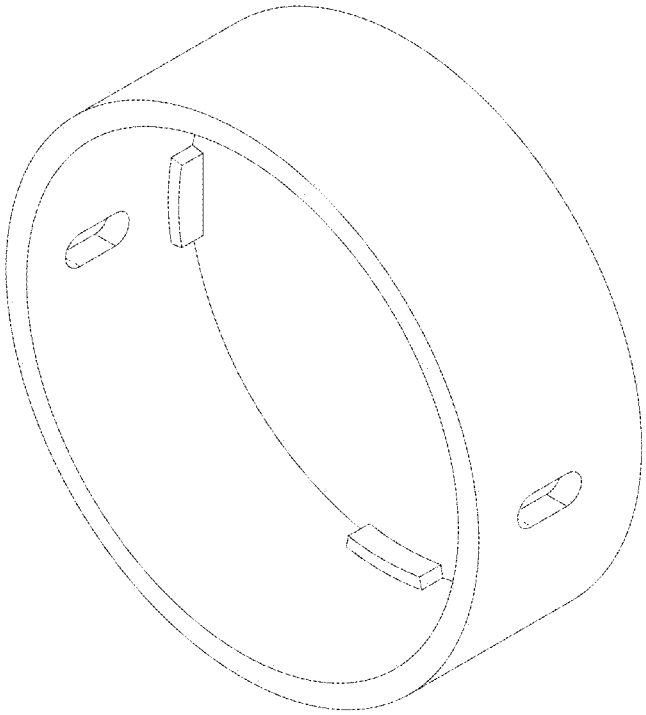
FIG. 3 is a schematic structural view of the transmission sleeve of the Fire-fighting water cannon in FIG. 1.

In some embodiments, the second anti-rotation device includes a second positioning screw 27 arranged on the cannon core 21, the second positioning screw 27 is threadedly connected with the cannon core 21, and the peripheral side wall of the transmission sleeve 28 is provided with a positioning hole for the second positioning screw 27 to extend into, and the second positioning screw 27 extends through the side wall of the cannon core 21 into the positioning hole. As shown in FIG. 3, optionally, the positioning hole is an oblong hole, and the oblong hole extends along the axial direction of the transmission sleeve 28. When the second housing 29 rotates, it is screwed with the transmission sleeve 28. The transmission sleeve 28 cannot rotate under the restriction of the second positioning screw 27, and can only be displaced along the axial direction. The positioning hole simultaneously drives the second positioning screw 27 to move, and the second positioning screw 27 drives the cannon core 21 to move in the axial direction. In order to prevent the rotation of the cannon core 21, the cannon core 21 may be connected with the central shaft 36 by a feather key.

Figure 4:
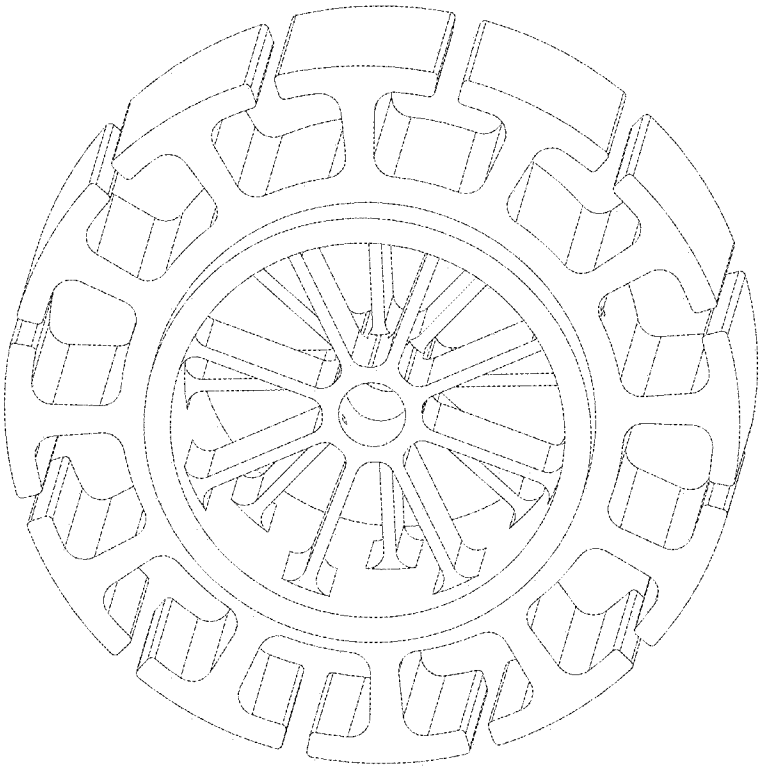
FIG. 4 is a schematic structural view of the flow stabilizer of the Fire-fighting water cannon in FIG. 1.

Refer to FIG. 1 and FIG. 4, in some embodiments, the first stator assembly includes a flow stabilizer 9 threadedly connected to the second end cover 2 and a first coil 8 mounted outside the flow stabilizer 9. For example, the first end of the flow stabilizer 9 is provided with an external thread, and the second end cover 2 is provided with an internal thread that matches the external thread. Referring to FIG. 4, a plurality of water flow channels for water flow through are provided in the middle of the flow stabilizer 9. The first rotor includes a rotor fixing ring 6 rotatably connected to the first housing 13 through a bearing, and a first permanent magnet 7 arranged on the rotor fixing ring 6 and opposite to the first coil 8. The first coil 8 is energized to generate a magnetic field, which causes the first permanent magnet 7 to rotate by force. For example, the rotor fixing ring 6 may include a ring body and a first support ring 5 and a second support ring 11 respectively provided at both ends of the ring body. The first support ring 5 is connected to the ring body by a second screw 4, and the second support ring 11 is connected to the ring body by a third screw 10. In addition, the first support ring 5 is rotatably connected with the first housing 13 through the first bearing 3, and the second support ring 11 is rotatably connected with the first housing 13 through the second bearing 12.

In some embodiments, external threads are provided on the outer circumferential side wall of the second end of the second cannon head 16, and the first end cover is provided with a clearance hole for the second support ring 11 of the rotor fixing ring 6 to extend. The end of the second support ring 11 close to the first end cover is provided with an internal thread that matches with the external thread, and the second cannon head 16 is screwed into the rotor fixing ring 6. When the first rotor assembly rotates, the thread pairs between the second support ring 11 and the second cannon head 16 are screwed together to drive the second cannon head 16 to move.

In some embodiments, a sealing ring is provided between the second support ring 11 of the rotor fixing ring 6 and the clearance hole. The sealing ring may refer to the second sealing ring 15 in FIG. 1, to prevent moisture from entering the second motor assembly.

In some embodiments, the first cannon head 19 is connected to the flow stabilizer 9 through a connecting sleeve 17, one end of the connecting sleeve 17 is threadedly connected to the first cannon head 19, and the other end is threadedly connected to the flow stabilizer 9. A sealing ring is provided between the connecting sleeve 17 and the second support ring 11 of the rotor fixing ring 6, for example, with reference to the first sealing ring 14 in FIG. 1. A sealing ring is provided between the first cannon head 19 and the second cannon head 16, for example, with reference to the third sealing ring 20 in FIG. 1, to prevent moisture from entering the second motor assembly.

In some embodiments, the first anti-rotation device includes a first positioning screw 18 threadedly connected to the outer circumferential side wall of the first cannon head 19, and the second cannon head 16 is provided with a slide slot for the first positioning screw 18 to extend into and slide therein. The slide slot extends along the axial direction of the second cannon head 16. With this arrangement, when the first rotor assembly rotates, it is threadedly engaged with the second cannon head 16. Since the first positioning screw 18 restricts the rotation of the second cannon head 16, the second cannon head 16 can only be displaced axially.

In some embodiments, the central shaft 36 is connected to the flow stabilizer 9 through a connecting ring 41. For example, the connecting ring 41 is threadedly connected with the flow stabilizer 9, the central shaft 36 is threadedly connected with the connecting ring 41, and the second end of the cannon core 21 is sleeved on the connecting ring 41.

The principles and implementations of the present invention are set forth by applying specific examples in the present specification, and the description of the above embodiments is merely used to help understanding the method and core idea of the present invention. Meanwhile, for a person of ordinary skill in the art, according to the idea of the present invention, there will be a change in the specific implementation and application range. In summary, the contents of the present description should not be construed as limiting the present invention.

What is claimed is:

1. A Fire-fighting water cannon, comprising:

a first motor assembly, including a first housing, a first stator assembly, a first rotor assembly, and a central shaft, wherein the first housing has a cavity inside and both ends of the first housing are respectively provided with a first end cover and a second end cover, the first stator assembly is arranged in the cavity and a first end of the first stator assembly is connected with the second end cover, the first rotor assembly is coaxially sleeved outside the first stator assembly with a gap therebetween, and the first rotor assembly is rotatably connected with the first housing through a bearing; when energized, the first rotor assembly rotates relative to the first stator assembly, and a first end of the center shaft is connected to a second end of the first stator assembly;

a cannon head assembly comprising a first cannon head and a second cannon head each having a cylindrical structure, wherein a first end of the first cannon head passes through the first end cover and is connected to the second end of the first stator assembly, the second cannon head is coaxially sleeved on the outside of the first cannon head, and a first end of the second cannon head is threadedly connected with the first rotor assembly, and the first cannon head is provided with a first anti-rotation device that prevents the second cannon head from rotating, so that when the first rotor assembly rotates, the second cannon head is axially displaced along the first cannon head, and each of a second end of the first cannon head and a second end of the second cannon head is provided with a tapered wide mouth, and the second end cover and the first stator assembly are both provided with holes through which water flows, so that the water spray out from the cannon head assembly through the second end cover and the first stator assembly;

a cannon core assembly, which is arranged on the central shaft and cooperates with the cannon head assembly to allow water to be discharged from a gap between the cannon head assembly and the cannon core assembly;

the cannon core assembly, including a cannon core, a second motor assembly, a spring, and a transmission sleeve, wherein the second motor assembly includes a second stator assembly and a second rotor assembly, and the second stator assembly is fixedly arranged at a second end of the center shaft, the second rotor assembly is coaxially sleeved on the outside of the second stator assembly, and is rotatably connected to the central shaft through a bearing; when energized, the second rotor assembly rotates relative to the second stator assembly, the transmission sleeve is sleeved on the outside of the second rotor assembly and is threadedly connected with the second rotor assembly, the cannon core is integrally sleeved on the central shaft, and a first end of the cannon core is sleeved on the outside of the transmission sleeve, and the cannon core is provided with a second anti-rotation device for preventing the rotation of the transmission sleeve, so that when the second rotor assembly rotates, the transmission sleeve drives the cannon core to move along the central shaft, the spring is arranged inside the cannon core, and one end of the spring is against the second motor assembly, and the other end is against the cannon core, an arc-shaped matching portion for matching with the tapered wide mouth of the first cannon head is provided on an outer peripheral wall of the cannon core.

2. The Fire-fighting water cannon according to claim 1, wherein the second stator assembly comprises a stator fixing ring sleeved on the central shaft and a second coil arranged on the stator fixing ring, the second rotor assembly includes a second housing and a second permanent magnet arranged in the second housing and opposite to the second coil; both ends of the second housing are respectively provided with a left end cover and a right end cover, the left end cover and the right end cover are respectively mounted on the central shaft through bearings.

3. The Fire-fighting water cannon according to claim 1, wherein the first end of the cannon core is provided with a central hole, and the first end of the cannon core is sleeved outside the transmission sleeve through the central hole, the central hole is provided with a blocking cover, the blocking cover is sleeved on the central shaft, one end of the blocking cover is against the second motor assembly, the other end is against the spring, a sealing ring is arranged between the blocking cover and the central hole.

4. The Fire-fighting water cannon according to claim 1, wherein the second anti-rotation device comprises a second positioning screw arranged on the cannon core, and the second positioning screw is threadedly connected with the cannon core, and a peripheral side wall of the transmission sleeve is provided with a positioning hole for the second positioning screw to extend into, and the second positioning screw extends through a side wall of the cannon core into the positioning hole.

5. The Fire-fighting water cannon according to claim 1, wherein the first stator assembly comprises a flow stabilizer threadedly connected with the second end cover and a first coil mounted outside the flow stabilizer, the flow stabilizer is provided with a water flow channel through which the water flows, the first rotor includes a rotor fixing ring rotatably connected with the first housing through a bearing, and a first permanent magnet arranged on the rotor fixing ring and opposite to the first coil.

6. The Fire-fighting water cannon according to claim 5, wherein external threads are provided on an outer circumferential side wall of a second end of the second cannon head, and the first end cover is provided with a clearance hole for the rotor fixing ring to extend, one end of the rotor fixing ring close to the first end cover is provided with an internal thread that matches with the external thread, and the second cannon head is screwed into the rotor fixing ring.

7. The Fire-fighting water cannon according to claim 6, wherein a sealing ring is provided between the rotor fixing ring and the clearance hole.

8. The Fire-fighting water cannon according to claim 5, wherein the first cannon head is connected to the flow stabilizer through a connecting sleeve, one end of the connecting sleeve is threadedly connected with the first cannon head, and the other end of the connecting sleeve is threadedly connected with the flow stabilizer, a sealing ring is arranged between the connecting sleeve and the rotor fixing ring, and a sealing ring is arranged between the first cannon head and the second cannon head.

9. The Fire-fighting water cannon according to claim 1, wherein the first anti-rotation device comprises a first positioning screw threadedly connected to an outer circumferential side wall of the first cannon head, and the second cannon head is provided with a slide slot for the first positioning screw to extend into and slide therein, and the slide slot extends along the axial direction of the second cannon head.

* * * * *